United States Patent [19]

Cera et al.

[11] Patent Number: 4,863,390

[45] Date of Patent: Sep. 5, 1989

[54] GROUND CONNECTOR

[75] Inventors: Robin P. Cera, Toronto; Ross H. Davies, Ontario, both of Canada

[73] Assignee: Burndy Corporation, Norwalk, Conn.

[21] Appl. No.: 270,659

[22] Filed: Nov. 14, 1988

[30] Foreign Application Priority Data

Sep. 9, 1988 [CA] Canada ..... 577049

[51] Int. Cl.[4] ..... H01R 4/44

[52] U.S. Cl. ..... 439/100; 439/792; 403/400

[58] Field of Search ..... 439/100, 781, 782, 791, 439/803, 792, 794; 174/7; 403/396, 400

[56] References Cited

U.S. PATENT DOCUMENTS

| | | | |
|---|---|---|---|
| 231,637 | 8/1880 | Wilcox | 403/400 |
| 1,795,627 | 7/1929 | Weritz et al. . | |
| 2,077,613 | 12/1934 | Bondenson . | |
| 2,234,022 | 3/1939 | Churchill . | |
| 3,892,455 | 3/1974 | Sotolongo . | |
| 3,985,411 | 6/1975 | Mooney et al. . | |
| 4,105,272 | 8/1978 | West et al. . | |
| 4,189,198 | 7/1978 | Reichman . | |
| 4,457,577 | 7/1984 | Brown et al. . | |
| 4,464,469 | 5/1987 | Sachs . | |

FOREIGN PATENT DOCUMENTS

| | | | |
|---|---|---|---|
| 753089 | 7/1956 | United Kingdom | 403/400 |

*Primary Examiner*—Gary F. Paumen

*Attorney, Agent, or Firm*—Karen M. Gerken

[57] ABSTRACT

A ground connector for securing a ground conductor with respect to a vertical support post. The connector includes a body member, a hook member and fastening means for securing the body and hook members to the support post. The body member is provided with a hook-like formation for receiving the conductor, and is adapted to be associated with the hook member. The hook member is intended to be disposed around the support post, and the fastening means is adapted to secure and to urge the body member into engagement with the support post such that the conductor directly contacts the post. The body member is specifically designed to accept conductor of various sizes. The hook member and the body member are particularly configured to engage support posts of square and round cross-section. The body member may be adapted to receive more than one conductor.

21 Claims, 2 Drawing Sheets

GROUND CONNECTOR

BACKGROUND OF THE INVENTION

1. Field of the Invention

The present invention pertains generally to clamping means and, more particularly, to a means for connecting, clamping or securing a wire, conduit, or the like to a vertical surface. More specifically, the invention relates to a single connector which is particularly adapted to connect a static/power grid ground conductor to various types of floor support pedestals in a computer installation system.

A typical computer installation involves locating the computer and power distribution interconnections beneath a raised floor in the computer room. The raised floor is constructed above the true floor of the structure, being supported above the true floor by means of vertical floor support pedestals. The latter types of floor support pedestals which are conventionally utilized are characterized by a vertical support post of either round or square cross-sectional configuration and being fabricated of steel and aluminum.

In order to insure the safety of computer personnel, it is essential that the computer equipment, as well as the electrical power distribution means from which it derives power, be properly grounded. The computer equipment and related enclosures must be connected to a reference grounding system to protect against high frequency noise. The power distribution system must be grounded in accordance with generally recognized safety standards, and should minimize noise pickup which might affect computer operation. The equipment grounding systems and the 60 Hz power distribution grounding network, which in effect comprise two separate grounding systems, must be bonded together for safety considerations to assure that no difference in potential exists exposed metal components.

The interconnection for the equipment and power distribution grounding systems are typically arranged beneath the raised floor of the computer room, with the floor support pedestals being utilized to establish a grounded grid that attenuates high-frequency noise. Proper attainment of the grid requires that the ground conductor be effectively secured to the raised floor support posts. Because each of the various system components in the overall data processing installation is associated with specialized contractors, i.e. computer manufacturer, electrical consultant/contractor, flooring contractor, the need exists for a ground connector which is able to be properly and easily installed on a floor support pedestal by a variety of contractors who might have access to the data processing installation, which is capable of accepting all types of existing floor support posts, which can be UL and CSA approved, and which effectively establishes a safe ground system. Moreover, the need exists for a single ground connector which is capable of coupling plural conductors to a vertical support post to establish a signal reference grid.

The subject invention addresses and satisfies the foregoing need for a ground connector by providing a connector which is particularly adapted for utilization in a computer grid ground system so as to reduce high frequency noise which might garble the computer language, to ground the power distribution system to minimize noise pickup from the associated electrical system, and to ground capacitance charge, such as static electricity, that can be present on flooring, carpeting, people and the like. The ground connector of the present invention achieves the preceding objectives by providing a ground connector adapted to be easily assembled to the vertical support post of a raised floor pedestal with only a few relatively simple components. The ground connector is uniquely designed to fasten one or plural ground conductors to a raised floor support post in order to create a computer grid ground system which is capable of performing the dual function of grounding static charges and electrical 60 Hz fault currents. Moreover, the ground connector of the invention possesses a novel design, enabling it to be mounted on all types of conventional support posts employed by the flooring industry. The latter types of vertical support posts include a square steel tube and a round steel or aluminum tube. The ground connector is adapted to secure the conductor to a flat side of the square tube or, alternatively, to a corner of the square tube formed by the convergence of two flat sides. In the case of a round tube, the ground connector is adapted to secure the conductor to a peripheral surface of the tube. The ground connector thus obtains direct low resistance contact between the conductor and the support post.

Additional salient attributes of the ground connector reside in its ability to accommodate a range of conductor and post sizes, and its adaptability to UL and CSA approval. The primary connector components are fabricated of tin plated bronze, thereby rendering the connector resistant to the potential corrosion which may result from cleaning fluids and liquid spills on the raised floor dripping thereunder onto the ground connector. As previously noted, the ground connector is simple to assemble, the respective components being secured together upon the support post by means of a nut which accepts a conventional nut driver, ratchet wrench or the like. The ease of assembly and relative simplicity of the ground connector allows it to be fastened to the floor support pedestal without the grounding conductor, thereby enabling floor installation trades to prefit the connector prior to installation of the grounding system by the appropriate specialists. By providing an effective, and virtually fail-safe connector, the subject invention eliminates the possibility that improper or makeshift devices will be installed on the floor supports to the detriment of safety and computer operating efficiencies.

2. Background of the Invention

It is known in the prior art to provide means for supporting a horizontal ground wire with respect to a vertical surface. U.S. Pat. No. 2,234,022, for example, shows a vertical fuse tube 1 having mounted thereon a clamping member which holds a wire by means of a pair of jaws. The clamping member secures the wire horizontally in relation to the post.

U.S. Pat. No. 4,189,198 discloses a coupling device for holding a ground wire. The coupling device, in turn, is attached to the vertical surface of a conduit coupling collar.

Similarly, U.S. Pat. No. 4,457,577 teaches a grounding clamp for coupling a cable tray to a horizontal grounding conductor. The grounding conductor is received in an upturned portion of the clamp. A second upturned portion of the clamp engages and is secured to the lip of the cable tray.

It is also generally known in the prior art to provide ground clamps for coupling a grounding cable and an electrical conduit. An example of such a device is shown in U.S. Pat. No. 3,985,411, wherein a clamp comprising complementary hinged clamp members embraces a conduit and a ground cable. U.S. Pat. No. 3,892,455 shows a similar ground clamp formed of a body portion and a cap portion.

U.S. Pat. No. 2,077,613 is directed to a ground fitting characterized by two parts which, when bolted together, receive a grounding pipe. One of the latter parts of the fitting is secured to a clamping piece which secures a grounding wire.

It can be seen from the prior art that the need exists for a ground clamp for computer installations which effectively establishes ground connections in a sub-floor grid, attenuates high frequency noise interference, grounds the power distribution system, grounds capacitance charge, and which is uncomplicated and easy to manufacture, corrosive-resistant, convenient to assemble, and adaptable to UL and CSA specifications.

SUMMARY OF THE INVENTION

The invention is directed to a ground connector for computer installations. The ground connector comprises a body member having an upper end an a lower end connected by means of an integral middle portion so as to form a body of generally C-shaped configuration. According to a preferred embodiment for the invention, the lower end of the body member is provided with a notched recessed edge particularly adapted to firmly abut the surface of a vertical support post. The upper end of the body member is provided with a hook-like formation specifically configured to receive a horizontally oriented wire conductor. The body member is adapted to be fastened to a vertical support post of a raised floor support pedestal, such that the notched edge of the body member, and the conductor wire supported by the hook-like formation, abut the vertical post.

Fastening of the body member to the support post is accomplished by means of a hook member. The hook member comprises a body having generally planar inner sides which define a cavity within which the support post is adapted to be received. An integral threaded portion is provided on the hook member, being adapted for insertion into a tapered through hole formed in the middle portion of the body member. Securing means is provided on the threaded portion for advancing the body member thereon in order to securely fasten the respective components and to urge the notched edge on the body member and the conductor supported by the body member into direct, secure contact with the support post.

Both the notched edge on the body member and the planar inner sides of the hook member are specifically designed so as to accept a vertical support post of round or square cross-sectional configuration. Additionally, the planar inner sides of the hook member are uniquely designed to allow the hook member to be placed on a square support post in diverse orientations. The hook-like formation of the body member is configured so as to receive a range of sizes of conductor wire.

A first alternative embodiment for the ground connector involves providing a hook-like formation on the lower end of the body member, the latter hook-like formation being essentially identical to the hook-like formation provided on the upper end of the body member. The presence of the additional hook-like formation on the lower end of the body member enables the single body member to support two conductors. The latter body member is adapted to be associated with the hook member and with a support post as has previously described so as to establish direct contact between each of the conductors and the support post. The body member of the first alternative embodiment is adapted to be assembled with respect to a round support post or the flat side of a square support post.

DESCRIPTION OF THE PREFERRED EMBODIMENT

Figure 1:
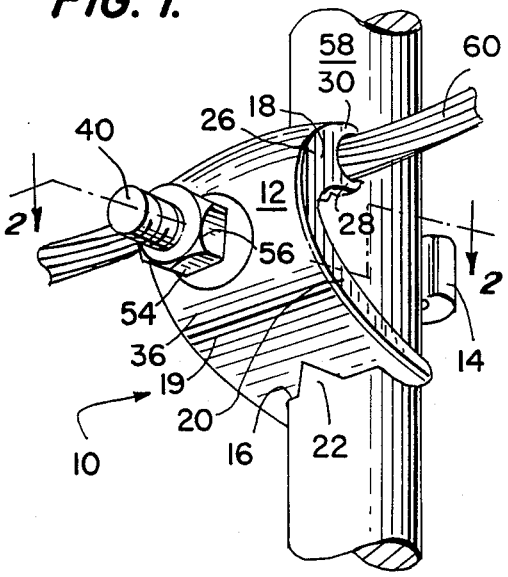
FIG. 1 is a perspective view of the ground connector of the present invention as it appears when assembled with respect to a round support post.
Figure 2:
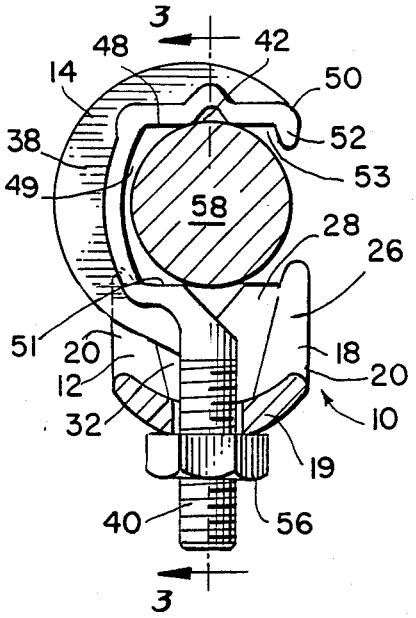
FIG. 2 is a top cross-sectional view of the ground connector taken along line 2—2 of FIG. 1.
Figure 3:
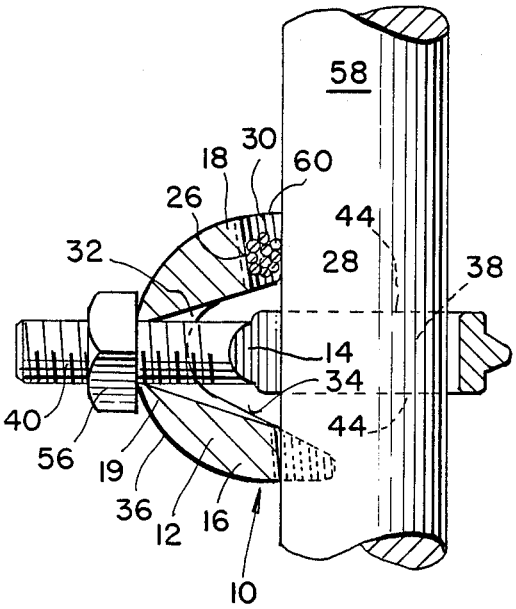
FIG. 3 is a side cross-sectional view of the ground connector taken along line 3—3 of FIG. 2.

The present invention can best be described in conjunction with the drawings and, in particular, with reference to FIGS. 1–4. A preferred embodiment for the ground connector 10 is shown generally in FIGS. 1–3, wherein it can be seen that the ground connector comprises a body member 12 and a hook member 14. As illustrated in FIGS. 1–3, the body member 12 is of generally C-shaped configuration, having a lower end 16 and an upper end 18, integrally associated with an arcuate middle section 19, and generally parallel side edges 20. The lower end 16 of the body member has a recessed planar edge 22, interrupted at the mid-point along its length by a generally V-shaped notch.

The upper end 18 of the body member terminates in a hook-like formation 26, which may have a projecting serrated bottom wall 28 and a serrated top wall 30 which projects slightly beyond the bottom wall as depicted in FIG. 3. The top and bottom walls define a major portion of a cavity or opening 31. A tapered through hole 32 is formed in the middle section 19 of the body member. As best shown in FIG. 3, the upper and lower ends of the body member, together with the middle section of the body member, define an interior cavity 34, with the through hole 32 tapering inwardly from the cavity to the outer surface 36 of the middle section of the body member.

The hook member 14, which is most clearly depicted in FIGS. 2 and 3, comprise a generally semi-circular hook body 38 and an integral threaded bolt portion 40. The hook body has generally parallel upper and lower edges 44, and an interior surface formed by adjacent sides 48, 49, each of which is of generally equal length. Side 48 is interrupted by a V-shaped notch 42. As shown in FIG. 2, the V-shaped notch is formed generally at the mid-point along the length of its respective planar side, and extends from the upper to the lower edges 44.

The terminal end 50 of the hook member is formed with a depending lip 52. A planar side 51, shorter in length than sides 48, 49 is integral with and perpendicular to side 49, as shown in FIG. 2. As also shown in FIG. 2, side 49 is of an arcuate shape. It can be seen from FIG. 2 that the planar sides of the interior surface of the hook member generally circumscribe an inner cavity 53.

The ground connector further includes a washer 54 and a nut 56 adapted to be received on the threaded portion 40 of the hook member. Both the body member and the hook member are preferably fabricated of tin plated bronze.

The four components of the ground connector as herein described are adapted to be operatively assembled by manually placing the hook member 14 on a vertical support post, typically the support post of a raised floor pedestal support. As shown in FIGS. 2 and 3, the hook member 14 is intended to be oriented with respect to the support post 58, which is of circular cross-sectional configuration, such that the post is disposed within the inner cavity 53, with the hook body 38 disposed around the post. The latter position is characterized by the peripheral surface of the round support post abutting at least a portion of the interior sides 48, 49 and 51.

The body member 12 is adapted to be associated to the hook member, and to the round post 58, by manually inserting the threaded portion 40 of the hook member into the enlarged end of the tapered through hole 32 of the body member. Assembly of a ground conductor 60 to the body member is intended to be accomplished by manually inserting the ground conductor in the cavity 31 formed by the hook-like formation at the upper end of the body member.

The components thus arranged are fastened together and firmly secured upon the round post by placing the washer 54 and the nut 56 on the threaded portion 40 of the hook member. The nut may be advanced the threaded portion by means of a conventional ratchet wrench, nut driver, or the like. Tightening of the nut upon the threaded portion obtains the fully assembled and operative position for the ground connector, wherein the lower end 16 of the body member engages the support 58 and, in particular, with the notched edge 22 grasping the round post. Additionally, the hook-like formation 26 at the upper end of the body member is directed against the post, such that conductor 60 establishes direct low-resistance contact with the support post. The serrated bottom and top walls 28 and 30 of the hook-like formation serve further to enable positive engagement with the post. The aforesaid intimate contact between the upper and lower ends of the body member and the post is achieved by means of the tapered through hole 32 causing the upper and lower ends to be urged toward the post upon tightening of the nut.

Figure 4:
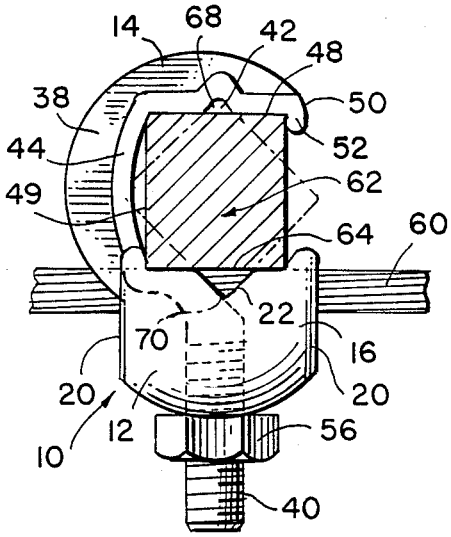
FIG. 4 is a top cross-sectional view of the ground connector as it appears when assembled to a square support post showing the ground conductor engaging in flat side of the support post, and with the ground conductor being shown engaging the corner of a square support post depicted in phantom.

FIG. 4 illustrates the ground connector of the present invention as it appears when applied to a support post 62 of square cross-sectional configuration. As shown therein, the hook member 14 may be assembled to the square post 62 such that two of the planar sides of the post substantially continuously abut, except for the notch 42, the planar sides 48 and 51 of the hook member. Moreover, as shown in FIG. 4, two next adjacent corners of the square post are received within the corners formed by the intersection of side 49 with sides 48 and 51. With the body member assembled to the hook member in the latter position, the ground conductor 60 is in contact with the flat side 64 of the square support post. Moreover, the notched edge 22 on the lower edge of the body member and the hook-like formation grasp the flat side 64 and two of the corners of the post.

A further orientation for the square support post with respect to the hook member and body member of the preferred embodiment is illustrated in phantom in FIG. 4, wherein two of the corners 68 of the square post are received within V-shaped notches formed in the planar sides 48, 51 of the hook member. When the body member is secured to the hook member, the ground conductor 60 contacts the corner 70 of the square post, with the notches on the upper edge of the body member grasping the corner 70 of the post.

Figure 5:
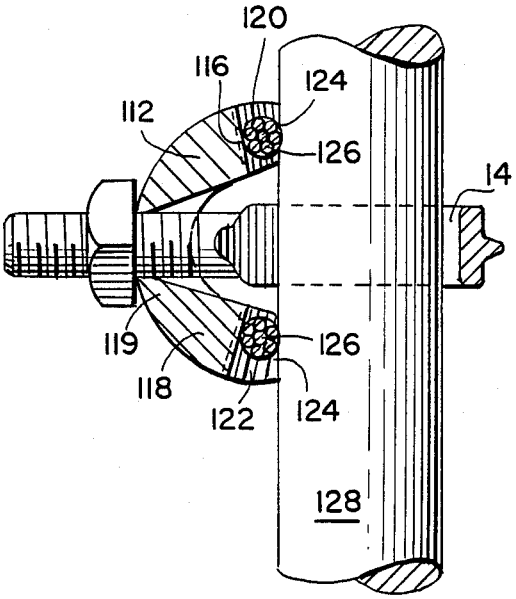
FIG. 5 is a side cross-sectional view of a first alternative embodiment for the ground connector.

A first alternative embodiment for the ground connector is illustrated in FIG. 5. The ground connector depicted in FIG. 5 is essentially identical to that discussed and shown in connection with the preferred embodiment and includes a body member 112 of generally C-shaped configuration and having an upper end 116 and a lower end 118, integrally connected by means of a middle section 119, and generally parallel side edges as was discussed in connection with FIGS. 1–4.

The upper end of the body member terminates in a first hook-like formation 120. The body member 112 differs from the body member 12 which was described in conjunction with the preferred embodiment in that the lower end of the body member 112 terminates in a second hook-like formation 122. The first and second hook-like formation 26 which was discussed in detail in conjunction with the preferred embodiment. In particular, each of the first and second hook-like formations define a major portion of a cylindrical cavity 124. As clearly depicted in FIG. 5, each of the first and second hook-like formations is adapted to receive a conductor 126.

The body member 112 is intended to be secured to a vertical support post 128 by means of a hook member 14 in the manner and method previously described in connection with the preferred embodiment. The ground connector of the alternative embodiment thus provides a single connector which is capable of securing plural conductors with respect to a vertical support of either round or square cross-sectional configuration.

Although the foregoing discussion sets forth a method of assembly for the ground connector, it should be noted that a variety of equally feasible alternative methods exist. For instance, the hook member may be assembled to the body member prior to placement of the hook member upon the support post. Furthermore, the hook and body members may be tightened upon the support post without the presence of the grounding conductor. The latter feature allows the ground connectors to be installed by the flooring trade, with installation of the actual grounding system being performed subsequent thereto by the appropriate electrical contractor. Subsequent installation of the ground wire may be easily accomplished merely by untightening the nut so as to enable the body member to be moved away from the support post to create space for the insertion of the wire. It is thus apparent that the ground connector possesses a "lay-in" feature, eliminating the potential for kinks and bends which tend to occur in the conductor when it must be passed through a recess in the coupling member. The "lay-in" attribute which is characteristic of the present invention also requires less conductor wire to form the reference grid than that required with pass-through devices.

The ground connector of the invention is specifically designed to accept a range of support post and conductor sizes. The sides 48 and 49 of the hook portion are approximately 1 inch in length, allowing the hook portion to accept $\frac{7}{8}$ inch square or a 1 inch round support post. The length of the notch edge 22 is around 1 inch, thereby enabling the body member to engage each of the aforesaid types of support posts.

Moreover, the diameter of the cavity that is formed by each of the hook-like formations of the body member is slightly greater than $\frac{1}{4}$ inch. This dimensional configuration permits the body member to receive ground conductors ranging in size for #8 to #4.

It is apparent from the foregoing description that the ground connector provides an effective means for securely coupling one or more ground conductors to a vertical support post. The ground connector is formed of only a few relatively uncomplicated components, which may be easily and properly assembled to a variety of support posts. The body member is securely fastened to the support post to establish the ground means of a hook member which is similarly adapted to accommodate a variety of support members. The body and hook members are formed of corrosive-resistant material, and may be installed as part of the flooring system prior to actual installation of the grounding system. The ground connector may be UL and CSA approved.

What is claimed is

1. A ground connector comprising a body member, a hook member and securing means for securing said body member and said hook member to a vertical support post, said body member having an upper end, lower end, and an integral middle portion, said upper and lower ends and said middle portion having continuous side edges, a hook-like formation provided on at least one of said upper and lower ends extending between said side edges of said end to define a cylindrical cavity, said hook-like formation being adapted to receive a horizontally oriented cable, a tapered through hole formed in said middle portion, said hook member having an outer edge, and an inner edge formed of at least two inner sides which are adjacent to each other, said hook member being integral with a threaded bolt portion, said threaded portion being adapted to be received within said through hole of said body member, said hook member being adapted to be disposed around said vertical support post such that said post abuts at least a portion of said inner sides, said securing means being adapted to be applied to said threaded portion whereby said body member is advanced upon said hook member such that said upper and lower ends are urged toward said support post whereby said cable which is received in said hook-like formation directly contacts said support post.

2. The ground connector recited in claim 1 wherein said lower end is provided with a recessed notched edge and said hook-like formation is provided on said upper end, said notched edge being adapted to engage said support post when said lower end is urged toward said support post.

3. The ground connector recited in claim 1 wherein said securing means comprises a nut which is adapted to be screwed upon said threaded portion.

4. The ground connector recited in claim 1 wherein said hook-like formation is adapted to receive cable of various cross-sectional diameters.

5. The ground connector recited in claim 1 wherein said hook member is adapted to be disposed around a vertical support post of round cross-sectional configuration.

6. The ground connector recited in claim 5 wherein said hook member is adapted to be disposed around a vertical support post of square cross-sectional configuration.

7. The ground connector recited in claim 5 wherein said round support post has a diameter of about 1 inch.

8. The ground connector recited in claim 6 wherein the sides of said square support post are about $\frac{7}{8}$ inch long.

9. The ground connector recited in claim 1 wherein said body member and said hook member are fabricated of tin plated bronze.

10. The ground connector recited in claim 1 wherein a said hook-like formation is provided on said upper and said lower end, each of said hook-like formations being adapted to receive a cable, said upper and lower ends being urged toward said support post when said body member is advanced upon said hook member whereby each of said cables directly contacts said support post.

11. A ground connector for coupling a ground conductor to a vertical support post, comprising a body member of generally C-shaped configuration and being defined by an upper end, a lower end, and an integral middle portion, said upper and lower ends and said middle portion having continuous generally parallel side edges, said lower end terminating in a recessed notched edge, said upper end terminating in a hook-like formation extending between said side edges of said upper end, said hook-like formation defining a cylindrical cavity for receiving a horizontally oriented ground conductor, a through hole formed in said middle portion, said through hole being inwardly tapered, a hook member for securing said body member to a vertical support post, said hook member being defined by an outer edge, upper and lower edges, and an inner edge formed of at least two inner sides which are substantially equal in length and which are adjacent to each other, a notch formed in at least one of said sides substantially at the mid-point of said length of said side, said hook member being integral with a threaded bolt portion, said threaded bolt portion being adapted to be received within said through hole of said body member, said hook member being adapted to be disposed around said vertical support post such that said post abuts at least a portion of said sides, a nut member adapted to be screwed upon said threaded portion whereby said body member is advanced upon said hook member and is urged toward said support post whereby said notched edge of said body member engages said support post and said conductor which is received in said hook-like formation directly contacts said support post.

12. The ground connector recited in claim 11 wherein said support post is of round cross-sectional configuration, said at least one side of said hook member being adapted to abut said support post proximate the location of said notch, said notched edge of said body member being adapted to engage said round post.

13. The ground connector recited in claim 11 wherein said support post is of square cross-sectional configuration, said at least one side, except for said notch, being adapted to continuously abut a side of said post, said notched edge of said body member being adapted to engage two of the corners which are formed by adjacent sides of said square post.

14. The ground connector recited in claim 13 wherein said notch formed in said at least one side is adapted to engage a corner which is formed by adjacent sides of said square post, said notched edge of said body member being adapted to engage another one of the corners of said square post.

15. The ground connector recited in claim 12 wherein said round support post has a diameter of about 1 inch.

16. The ground connector recited in claim 13 wherein said sides of said square support posts are about $\frac{7}{8}$ inch long.

17. The ground connector recited in claim 1 wherein said hook-like formation is adapted to receive a ground conductor which is about $\frac{1}{8}$ inch or around $\frac{1}{4}$ inch in diameter.

18. A method of using a ground connector characterized by a body member, a hook member and a fastening member, said body member having an upper end, a lower end and an integral middle portion, a recessed notched edge provided on said lower end for engaging a vertical support post, a hook-like formation defining a cylindrical cavity provided on said upper end for receiving a ground conductor, a tapered through hole formed in said middle portion for receiving a threaded portion of said hook member, a hook body unitary with said threaded portion, said hook body having an outer edge and an inner edge formed of at least two adjacent and perpendicular sides, said sides being of substantially the same length, a notch formed in at least one of said sides substantially at the mid-point of said length of said sides, said hook member being adapted to be disposed around said support post, said fastening member being adapted to advance said body member on said threaded portion, the method comprising the steps of:

(a) manually inserting said threaded portion into said through hole of said body member;

(b) manually placing a conductor within said hook-like formation of said body member;

(c) placing said hook member around said support post such that said support post abuts at least a portion of said sides;

(d) applying said fastening means to said threaded portion;

(e) advancing said fastening means on said threaded portion whereby said body member is urged toward said support post such that said notched edge of said body member engages said support post and said conductor is secured in direct contact with said support post.

19. A method recited in claim 18 wherein said hook member is placed around a support post of round cross-sectional configuration.

20. The method recited in claim 18 wherein said hook member is placed around a support post of square cross-sectional configuration such that said at least one side of said hook member, except for said notch, substantially continuously abuts an adjacent side of said square post.

21. The method recited in claim 18 wherein said hook member is placed around a support post of square cross-sectional configuration such that a corner of said square post is received within said notch.

* * * * *